US011854395B2

(12) United States Patent
Otsuki et al.

(10) Patent No.: US 11,854,395 B2
(45) Date of Patent: Dec. 26, 2023

(54) TRAFFIC MANAGEMENT SYSTEM, TRAFFIC MANAGEMENT METHOD, AND TRAFFIC MANAGEMENT PROGRAM

(71) Applicant: TOYOTA JIDOSHA KABUSHIKI KAISHA, Toyota (JP)

(72) Inventors: Nobuhisa Otsuki, Toyota (JP); Kunihiro Iwamoto, Toyota (JP); Yuta Itozawa, Nagoya (JP); Hirotaka Komura, Setagaya-ku Tokyo-to (JP); Yutaro Takagi, Edogawa-ku Tokyo-to (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 159 days.

(21) Appl. No.: 17/487,160

(22) Filed: Sep. 28, 2021

(65) Prior Publication Data

US 2022/0108612 A1 Apr. 7, 2022

(30) Foreign Application Priority Data

Oct. 2, 2020 (JP) ..... 2020-168118

(51) Int. Cl.

| | |
|---|---|
| ***G08G 1/123*** | (2006.01) |
| ***G08G 1/09*** | (2006.01) |
| ***G08G 1/01*** | (2006.01) |
| ***G08G 1/017*** | (2006.01) |

(52) U.S. Cl.

CPC ..... *G08G 1/123* (2013.01); *G08G 1/017* (2013.01); *G08G 1/0125* (2013.01); *G08G 1/091* (2013.01)

(58) Field of Classification Search

CPC ..... G08G 1/123; G08G 1/0125; G08G 1/017; G08G 1/091

See application file for complete search history.

(56) References Cited

U.S. PATENT DOCUMENTS

| | | | | |
|---|---|---|---|---|
| 9,921,070 | B1 * | 3/2018 | Nimchuk | G01C 21/3679 |
| 10,429,197 | B1 * | 10/2019 | Carrino | G01C 21/20 |
| 2010/0057358 | A1 * | 3/2010 | Winer | G01C 21/3667 701/414 |
| 2017/0069001 | A1 * | 3/2017 | Scofield | H04W 4/42 |
| 2017/0176193 | A1 * | 6/2017 | Chau | G01C 21/3407 |

FOREIGN PATENT DOCUMENTS

| | | | |
|---|---|---|---|
| JP | 2018-053661 | A | 4/2018 |
| JP | 2019-196136 | A | 11/2019 |
| KR | 20100057553 | A | 5/2010 |

* cited by examiner

*Primary Examiner* — Hussein Elchanti
(74) *Attorney, Agent, or Firm* — Dinsmore & Shohl LLP

(57) ABSTRACT

The plurality of passage areas include a first passage area and a second passage area, the first passage area being a passage area for which a traveling condition for a transportation vehicle carrying an object to be transported is specified, and a second passage area being a passage area for which a traveling condition for restricting traveling of the transportation vehicle more strictly than in the first passage area is specified. The traffic management system includes a traffic management unit configured to change a regulation in at least a part of the second passage area in regard to the permission/prohibition of the traveling of the transportation vehicle based on at least one of information about a demand for the object to be transported and information about a traffic environment.

6 Claims, 14 Drawing Sheets

TRAFFIC MANAGEMENT SYSTEM, TRAFFIC MANAGEMENT METHOD, AND TRAFFIC MANAGEMENT PROGRAM

CROSS REFERENCE TO RELATED APPLICATIONS

This application is based upon and claims the benefit of priority from Japanese patent application No. 2020-168118, filed on Oct. 2, 2020, the disclosure of which is incorporated herein in its entirety by reference.

BACKGROUND

The present disclosure relates to a traffic management system, a traffic management method, and a traffic management program.

A management system for managing a traffic environment including a plurality of types of roads which different types of moving objects can respectively pass through has been known (see, for example, Japanese Unexamined Patent Application Publication No. 2018-053661).

SUMMARY

In such a traffic environment, it is desirable to give a degree of freedom to the traveling of transportation vehicles carrying objects to be transported (hereinafter also referred to as distribution vehicles) according to the situation of the traffic environment.

The present disclosure has been made to solve such a problem and an object thereof is to provide a traffic management system, a traffic management method, and a traffic management program capable of giving a degree of freedom to traveling of transportation vehicles in a traffic environment including a plurality of types of roads which different types of moving objects can respectively pass through.

A first exemplary aspect is a traffic management system in a traffic environment including a plurality of types of passage areas, the plurality of types of passage areas being regulated so that types of moving objects permitted to pass therethrough differ from one passage area to another, in which the plurality of passage areas include a first passage area and a second passage area, the first passage area being a passage area for which a traveling condition for a transportation vehicle carrying an object to be transported is specified, and being a road, and a second passage area being a passage area for which a traveling condition for restricting traveling of the transportation vehicle more strictly than in the first passage area is specified, and the traffic management system includes a traffic management unit configured to change a regulation in regard to permission/prohibition of the traveling of the transportation vehicle in at least a part of the second passage area based on at least one of information about a demand for the object to be transported and information about a traffic environment.

Another exemplary aspect is a method for managing traffic in a traffic environment including a plurality of types of passage areas, the plurality of types of passage areas being regulated so that types of moving objects permitted to pass therethrough differ from one passage area to another, in which the plurality of passage areas include a first passage area and a second passage area, the first passage area being a passage area for which a traveling condition for a transportation vehicle carrying an object to be transported is specified, and being a road, and a second passage area being a passage area for which a traveling condition for restricting traveling of the transportation vehicle more strictly than in the first passage area is specified, and the method includes relaxing the traveling condition for the transportation vehicle in at least a part of the second passage area based on at least one of information about a demand for the object to be transported and information about a traffic environment.

Another exemplary aspect is a traffic management program in a traffic environment including a plurality of types of passage areas, the plurality of types of passage areas being regulated so that types of moving objects permitted to pass therethrough differ from one passage area to another, in which the plurality of passage areas include a first passage area and a second passage area, the first passage area being a passage area for which a traveling condition for a transportation vehicle carrying an object to be transported is specified, and being a road, and a second passage area being a passage area for which a traveling condition for restricting traveling of the transportation vehicle more strictly than in the first passage area is specified, and the traffic management program causes a computer to perform relaxing the traveling condition for the transportation vehicle in at least a part of the second passage area based on at least one of information about a demand for the object to be transported and information about a traffic environment.

According to the present disclosure, it is possible to give a degree of freedom to traveling of transportation vehicles in a traffic environment including a plurality of types of roads which different types of moving objects can respectively pass through.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

The present disclosure will be explained hereinafter through embodiments according to the present disclosure. However, the below-shown embodiments are not intended to limit the scope of the present disclosure specified in the claims. Further, all of the components/structures described in the embodiments are not necessarily indispensable for solving the problem.

First Embodiment

A traffic management system 100 according to a first embodiment will be described hereinafter with reference to the drawings. A traffic environment according to an embodiment includes a plurality of types of passage areas which are regulated so that types of moving objects permitted to pass therethrough differ from one passage area to another. Each of the passage areas is an area where moving objects such as people or vehicles can pass therethrough, and may be a road. Alternatively, the passage area may be an open square or a park.

The plurality of passage areas include a first passage area and a second passage area. The first passage area is a passage area for which a traveling condition for transportation vehicles carrying objects to be transported (hereinafter also referred to as transported objects) is specified, and is a road. The second passage area is a passage area for which a traveling condition for restricting traveling of the transportation vehicle more strictly than in the first passage area is specified. That is, the second passage area is a passage area in which it is more difficult for transportation vehicles to pass therethrough than to pass through the first passage area.

For example, it may be specified that the first passage area be a passage area which transportation vehicles can pass through, and the second passage area be a passage area which transportation vehicles cannot pass through. Further, the first passage area may be a passage area which larger transportation vehicles are permitted to travel through than those permitted to travel through the second passage area, or a passage area in which transportation vehicles are permitted to travel through at a higher speed than a speed at which they are permitted to travel through the second passage area. Alternatively, the first passage area may be a passage area in which a larger number of transportation vehicles are permitted to travel at the same time than the number of transportation vehicles that are permitted to travel in the second passage area at the same time.

Figure 1:
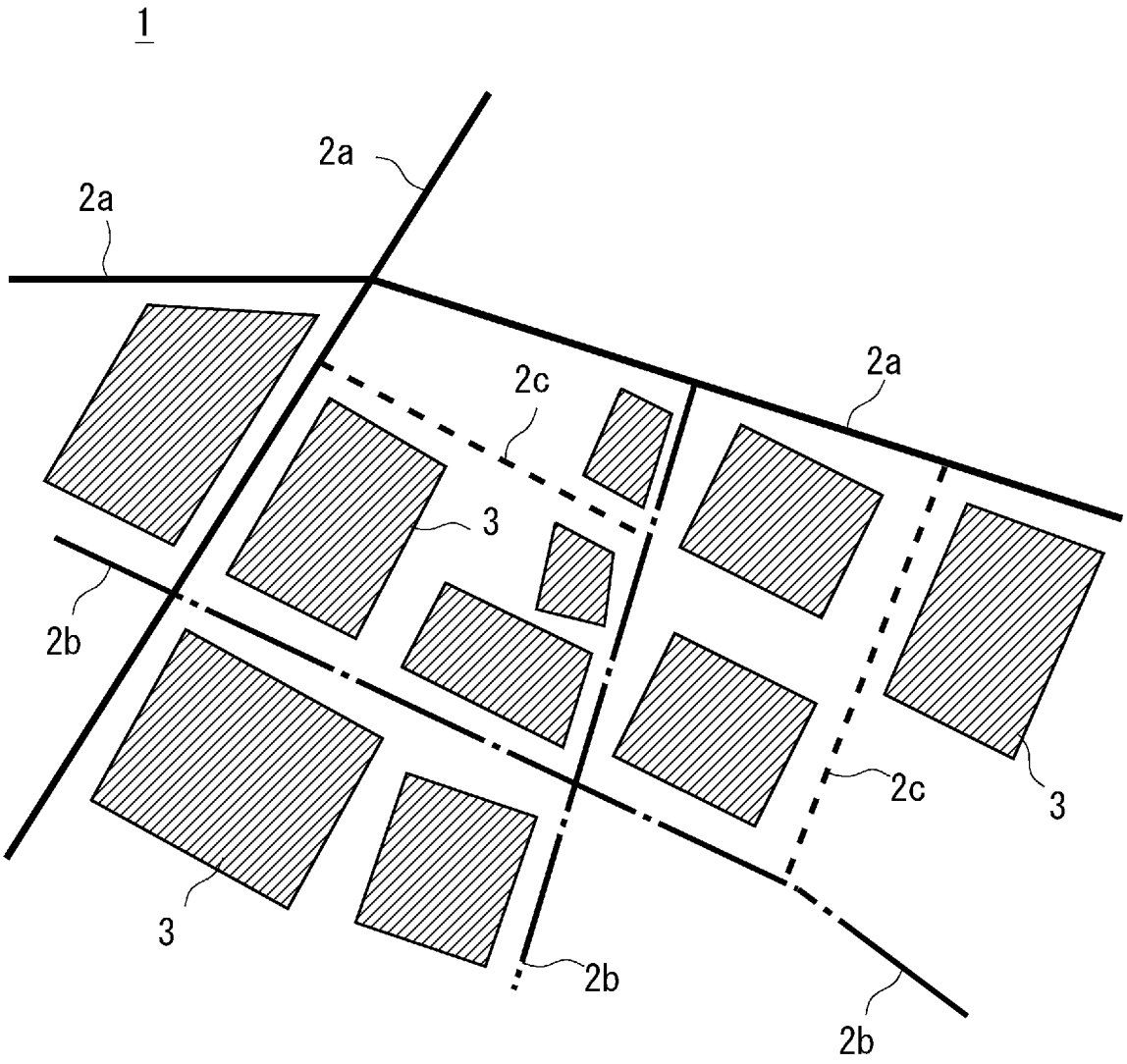
FIG. 1 is a schematic diagram showing an example of a traffic environment managed by a traffic management system.

FIG. 1 is a schematic diagram showing an example of a traffic environment 1 managed by the traffic management system 100. The traffic environment 1 includes three kinds of roads 2*a*, 2*b* and 2*c*. The roads 2*a*, 2*b* and 2*c* may be a high-speed road, an intermediate-speed road, and a low-speed road, respectively, and may have speed limits different from one another. Note that the traffic environment 1 may include only two types of roads, or four or more types of roads. Note that the traffic environment 1 may include a road(s) provided (e.g., constructed) underground. The traffic environment 1 may be an area that is designed on the premise that autonomously-driven vehicles travel therethrough, such as a Smart City.

Buildings 3 are houses, office buildings, factories, and the like. In areas surrounded by roads, facilities such as parks as well as the buildings 3 may be provided (e.g., constructed). Note that the roads 2*a*, 2*b* and 2*c* may be roads that pass through (i.e., are extended across) the middle of a park. The road may be curved or bent at any midpoint therein according to the geographic feature, the arrangement of buildings, and the like. Further, the width of the road may be changed at any midpoint therein.

The roads 2*a*, 2*b* and 2*c* have different regulations for moving objects that are permitted to pass therethrough. The roads 2*a*, 2*b* and 2*c* may be areas which people can pass through (i.e., areas which people are permitted to pass through) or areas which moving objects can travel through (i.e., areas which moving objects are permitted to travel through). That is, the moving object may be a person or a vehicle. The vehicle may be an autonomously-moving vehicle or a vehicle driven by a human driver.

Each of the roads 2*a*, 2*b* and 2*c* may have a regulation so that only one type of moving objects can pass therethrough, may has a regulation so that a plurality of types of moving objects can pass therethrough. That is, it may be specified that: the movable objects that can pass through the road 2*a* be vehicles A; the movable objects that can pass through the road 2*b* be vehicles B; and the movable objects that can pass through the road 2*c* be people. Alternatively, it may be specified that: the movable objects that can pass through the road 2*a* be vehicles A; the movable objects that can pass through the road 2*b* be vehicles A and B; and the movable objects that can pass through the road 2*c* be vehicles A and B and people.

According to the above-described regulations, there may be a road which transportation vehicles carrying transported objects can travel through, and a road which such transportation vehicles cannot travel through. Here it is assumed that the roads 2*a* to 2*c* in the traffic environment 1 include a road for which it is specified that transportation vehicles can travel therethrough (hereinafter referred to as a first road), and a road for which it is specified that transportation vehicles cannot travel therethrough (hereinafter referred to as a second road). For example, it may be specified that transportation vehicles can travel through the roads 2*a* and 2*b*, and transportation vehicles cannot travel through the road 2*c*.

Note that, as described above, the traveling condition does not necessarily have to be a condition in regard to permission/prohibition of traveling. For example, it may be specified that transportation vehicles can travel through the roads 2*a* and 2*b*, and the traveling condition for transportation vehicles (such as the number of vehicles, the size thereof, the speed thereof) be stricter in the road 2*a* than in the road 2*b*. That is, the traveling condition may be a condition(s) in regard to at least one of the number of transportation vehicles, the speed thereof, and the size of thereof. For example, as a traveling condition, the specified number of transportation vehicles 300 that can travel through the first passage area may be larger than that of transportation vehicles 300 that can travel through the second passage area. As a traveling condition, the specified size of transportation vehicles 300 that can travel through the first passage area may be larger than that of transportation vehicles 300 that can travel through the second passage area. As a traveling condition, the specified upper limit of the speed of transportation vehicles 300 traveling in the first passage area may be higher than that of the speed of transportation vehicles 300 traveling in the second passage area. As an example of them, a reference value may be set for each traveling condition. For example, the number of transportation vehicles 300 in the first passage area may be set to a number larger than a reference value, and the number of transportation vehicles 300 in the second passage area may be set to a number smaller than the reference value.

Figure 2:
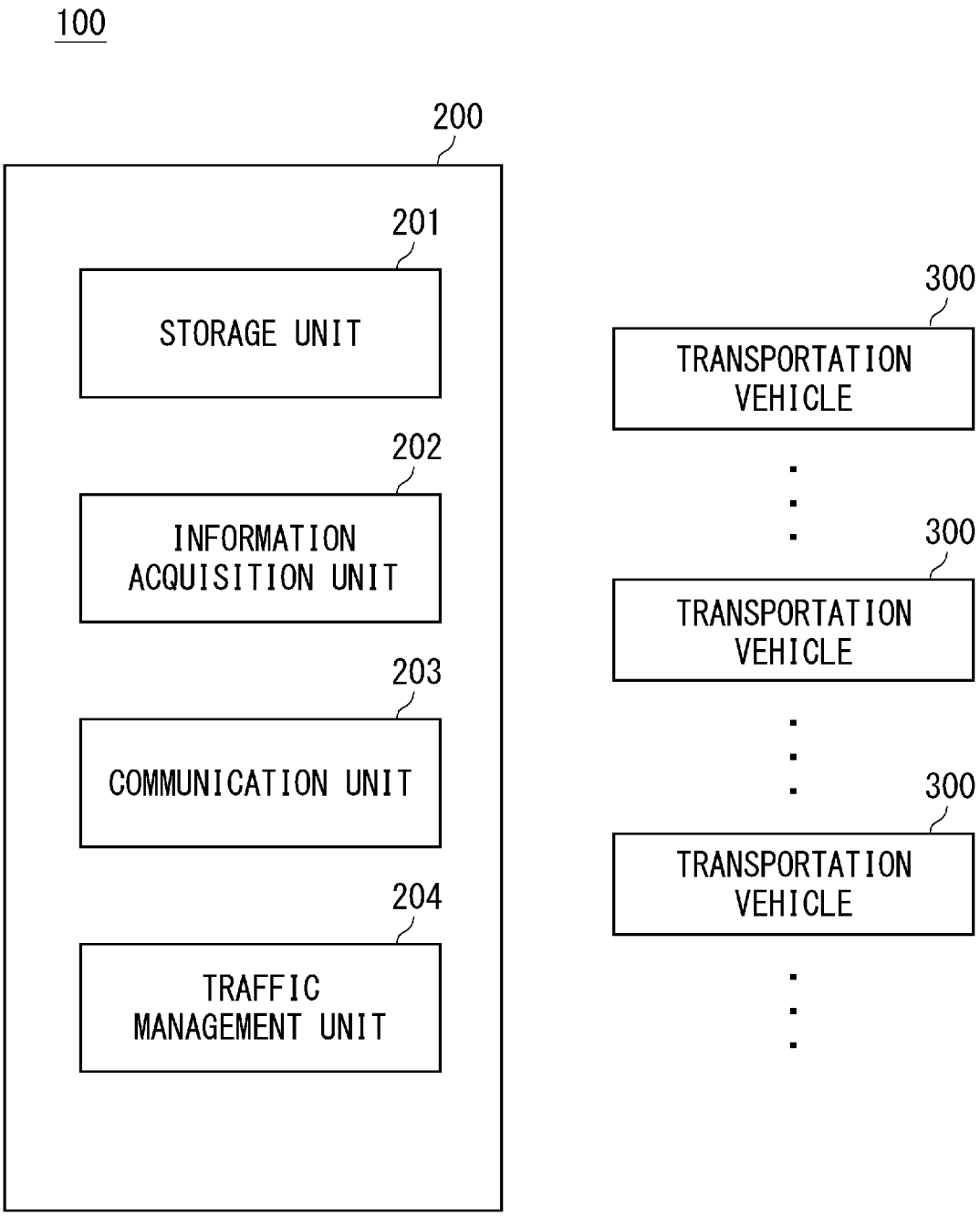
FIG. 2 is a block diagram showing a configuration of a traffic management system according to a first embodiment.

Next, a functional configuration of the traffic management system 100 will be described with reference to FIG. 2. The traffic management system 100 includes a management apparatus 200 and one or a plurality of transportation vehicles 300. Note that the traffic management system 100 may further include vehicles other than the transportation vehicles 300. For example, the traffic management system 100 may further include, in addition to the transportation vehicles 300 which are transportation robots, electric vehicles on which people can ride.

Each of the transportation vehicles 300 is a vehicle for transporting transported objects such as objects to be delivered, and is also called a distribution vehicle. The transportation vehicle 300 may be an autonomously-driven vehicle that is autonomously driven to a destination. In this way, it is possible to transport a transported object to its destination. The transportation vehicle 300 includes a control unit for performing autonomous driving. The control unit performs a steering operation, and operations for acceleration and braking. The transportation vehicle 300 is equipped with a sensor(s) such as a camera(s) for performing autonomous driving.

The transportation vehicle 300 may be an electric bicycle, a motorcycle, any of various types of mobile objects, a truck, a bus, a robot, or the like. The number of transportation vehicles 300 and the type thereof in the traffic management system 100 are not limited to any particular number and any particular type.

The transportation vehicle 300 is controlled in an autonomously-driven manner so as to travel along a traveling route from a starting point (or the current position) to a destination. The traveling route is generated by route searching from the starting point to the destination. The route searching may be performed on the transportation vehicle 300 side or on the management apparatus 200 side. Note that the traveling route of the transportation vehicle 300 is generated so as to be composed of roads which the transportation vehicle 300 can travel through. In other words, the travel route of the transportation vehicle 300 is generated so as not to include any road which the transportation vehicle 300 cannot travel through.

The management apparatus 200 is, for example, an information processing apparatus such as a server apparatus. The management apparatus 200 includes a processor, a memory, and the like. A management program for managing autonomous driving performed by the transportation vehicle 300 is stored in a memory of the management apparatus 200. The management apparatus 200 manages the autonomous driving of the transportation vehicle 300 by executing the management program. Note that the management apparatus 200 is not limited to a standalone physical apparatus. For example, a traffic management method may be implemented by having each of a plurality of information processing apparatuses connected to a network perform distributed processing.

The management apparatus 200 includes a storage unit 201, an information acquisition unit 202, a communication unit 203, and a traffic management unit 204.

The storage unit 201 includes a memory or the like, and stores map information therein. The map information is information about a map of a traveling area (the traffic environment 1) in which the transportation vehicle 300 travels. As described above, the traffic environment 1 includes a plurality of types of roads. The management apparatus 200 may manage, for each of the roads, vehicles that can travel through that road.

The map information includes information about roads, buildings, facilities, and the like. For example, the map information includes information about, each of the roads, the location of that road, the width thereof, the number of lanes thereof, the shape thereof, the direction (i.e., orientation) thereof, and the like. Further, the map information includes information about the locations of buildings, facilities, and the like, the shapes thereof, the sizes thereof, and the like. The location information of each of roads, buildings, and the like is represented by coordinates such as a latitude, a longitude, or the like, and may further include information about an altitude. Further, the map information may be general-purpose data that is originally used for a navigation system and the like. The map information may include information about nodes and links.

Note that the road may be a road actually existing in the traffic environment or a road existing as digital information. When the road actually exists in the traffic environment, the traffic management system 100 can manage which roads the vehicle travels through. Further, when the road exists as digital information, the traffic management system 100 can increase or decrease the number of roads.

In the map information, for each road, road-type information indicating the type of that road may be added. The type information is, for example, information indicating, for each road, which of the aforementioned high-speed road, the intermediate-speed road, and the low-speed road that road corresponds to. Note that when a road has two lanes on each side (i.e., in each direction), it is possible to use a lane close to the center of the road as a high-speed road, and use a lane close to a sidewalk as an intermediate-speed road. Further, when there are restrictions on the size of vehicles, the speed thereof, and the like, these conditions (i.e., these restrictions) may be used as road-type information.

The information acquisition unit 202 acquires at least one of information about a demand for a transported object (hereinafter also referred to as demand information) and information about a traffic environment (hereinafter also referred to as traffic-environment information). The demand information may be, for example, information about the quantity of the transported object to be transported or information about the urgency of the transportation. For example, when the quantity of transported objects to be transported is large, a larger number of transportation vehicles 300 travel. Therefore, it is considered that the transportation time of the transportation vehicle 300 increases due to the occurrence of a traffic jam or the like. The traffic-environment information includes, for example, information about the speeds of vehicles, the number of vehicles, the number of pedestrians, and the like in the traffic environment 1. For example, it is considered that when a large number of vehicles are traveling, the transportation time of the transportation vehicle 300 increases.

The demand information may be information calculated based on the day of the week, the time in the day, and the like. Note that the demand information may be calculated by using demand information in the past. Further, the demand information may be information calculated based on information about the order of the transported object. The management apparatus 200 may function as a server that receives an order for a transported object from a user.

The traffic-environment information may be acquired, for example, from a group of sensors (not shown). The group of sensors (hereinafter also referred to as a sensor group) are arranged in the traveling environment including roads and their surroundings. The traveling environment includes intersections and the like. For example, the sensor group may be attached to traffic lights on the roadside, street lights, traffic signs, and structures for installing such devices. Alternatively, the sensor group may be provided in buildings on the roadside, utility poles, and pedestrian bridges. Further, the places where the sensors are provided are not limited to the roofs and the outer walls of buildings. That is, the sensors may be provided indoors. The places where the sensors are provided are not limited to the aforementioned examples.

The sensor may be a LIDAR (Light Detection and Ranging, Laser Imaging Detection and Ranging) that detects a distance and a direction to an object to be detected, a millimeter wave radar, a camera, or the like. The object to be detected is a vehicle, a pedestrian, or the like.

The sensor group transmits the result of the detection such as the speeds of vehicles, the number of vehicles, the number of pedestrians, and the like to the management apparatus 200 in the form of a radio signal. For example, the sensor group transmits/receives data to/from the management apparatus 200 through a wireless network. For the communication of data between the sensor group and the management apparatus 200, a general-purpose wireless network such as WiFi (Registered Trademark), 4G, or 5G can be used.

The communication unit 203 is a communication interface for communicating with the transportation vehicle 300 and the sensor group (not shown). The communication unit 203 transmits/receives data to/from the transportation vehicle 300 and the like through, for example, a wireless network. For the communication of data between the transportation vehicle 300 and the management apparatus 200, a general-purpose wireless network such as WiFi (Registered Trademark), 4G, or 5G can be used.

The traffic management unit 204 generates a traveling route for the transportation vehicle 300 in such a manner that the generated traveling route is composed of roads which the transportation vehicle 300 can travel through. The traffic management unit 204 may further generate a traveling route for vehicles other than the transportation vehicle in such a manner that the generated traveling route is composed of roads which the vehicles can travel through. Further, for each vehicle, the traffic management unit 204 may transmit, to that vehicle, management information in regard to roads which that vehicle can travel through. Then, each vehicle may generate its traveling route. Note that the management information may be information about the speed limit of the vehicle.

Further, the traffic management unit 204 may transmit management information in regard to roads which the transportation vehicle 300 can travel through to a navigation apparatus installed in the transportation vehicle 300. The human driver of the transportation vehicle 300 checks the screen of the navigation apparatus and thereby drives the transportation vehicle 300 through roads which the transportation vehicle 300 can travel through. That is, the transportation vehicle 300 does not necessarily have to be an autonomously-driven vehicle.

Note that the traffic management unit 204 relaxes the traveling condition in at least a part of the second passage area based on the information acquired by the information acquisition unit 202. For example, the traffic management unit 204 may permit the transportation vehicle 300 to pass through the second passage area, or may cancel the restriction in regard to the speed of the transportation vehicle 300, the size thereof, the number thereof, or the like.

For example, the traffic management unit 204 may change the regulation in regard to the permission/prohibition of the traveling of the transportation vehicle 300 in at least a part of the second road based on the information acquired by the information acquisition unit 202. When the road 2*a* is a first road and the roads 2*b* and 2*c* are second roads, the traffic management unit 204 may change the regulation so that the transportation vehicle 300 can travel through the road 2*b*, or may change the regulation so that the transportation vehicle 300 can travel through either of (or both of) the roads 2*b* and 2*c*.

The traffic management unit 204 may relax the traveling condition based on either the demand information or the traffic-environment information, or may relax the traveling condition based on both the demand information and the traffic-environment information. The traffic management unit 204 may relax the traveling condition when the demand information in regard to the quantity of the demand or the like, or the traffic-environment information in regard to the vehicle speed or the like exceeds its threshold. Alternatively, the traffic management unit 204 may simulate a transportation time based on the information acquired by the information acquisition unit 202 and relax the traveling condition according to the result of the simulation.

The traffic management unit 204 transmits a traveling route that is generated based on the regulation to the transportation vehicle 300. Alternatively, the traffic management unit 204 may transmit management information indicating the permission/prohibition of the traveling for each road to the transportation vehicle 300, and the transportation vehicle 300 may generate a traveling route based on the received information. Note that the management apparatus 200 may acquire, for each vehicle, information about the position of that vehicle, and transmit, to that vehicle, only information indicating the permission/prohibition of the traveling in the area around that vehicle.

Figure 3:
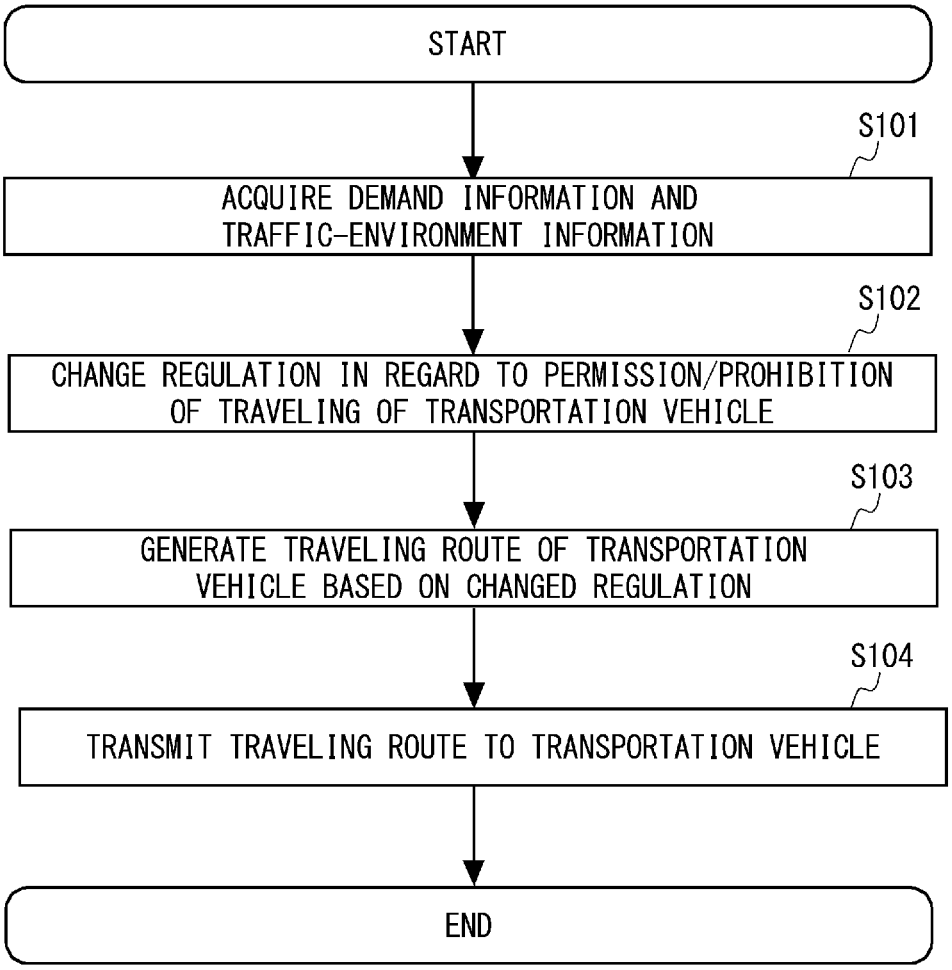
FIG. 3 is a flowchart showing operations performed by the traffic management system according to the first embodiment.

FIG. 3 is a flowchart showing an example of operations performed by the traffic management system 100 according to the first embodiment. The information acquisition unit 202 of the traffic management system 100 acquires demand information and traffic-environment information (Step S101). Next, the traffic management unit 204 of the traffic management system 100 changes the regulation in regard to the permission/prohibition of the traveling in at least a part of the second road based on the information acquired in the step S101 (Step S102). The type of roads through which the passage is permitted may be set as appropriate. As described above, the traffic management unit 204 may relax the traveling condition. Next, the traffic management unit 204 of the traffic management system 100 generates a traveling route for the transportation vehicle 300 based on the changed regulation (Step S103). Lastly, the traffic management unit 204 transmits the generated traveling route to the transportation vehicle 300 (Step S104). Note that the traffic management unit 204 may transmit management information for permitting the passage through the road for which the regulation has been changed to the transportation vehicle 300.

Figure 4:
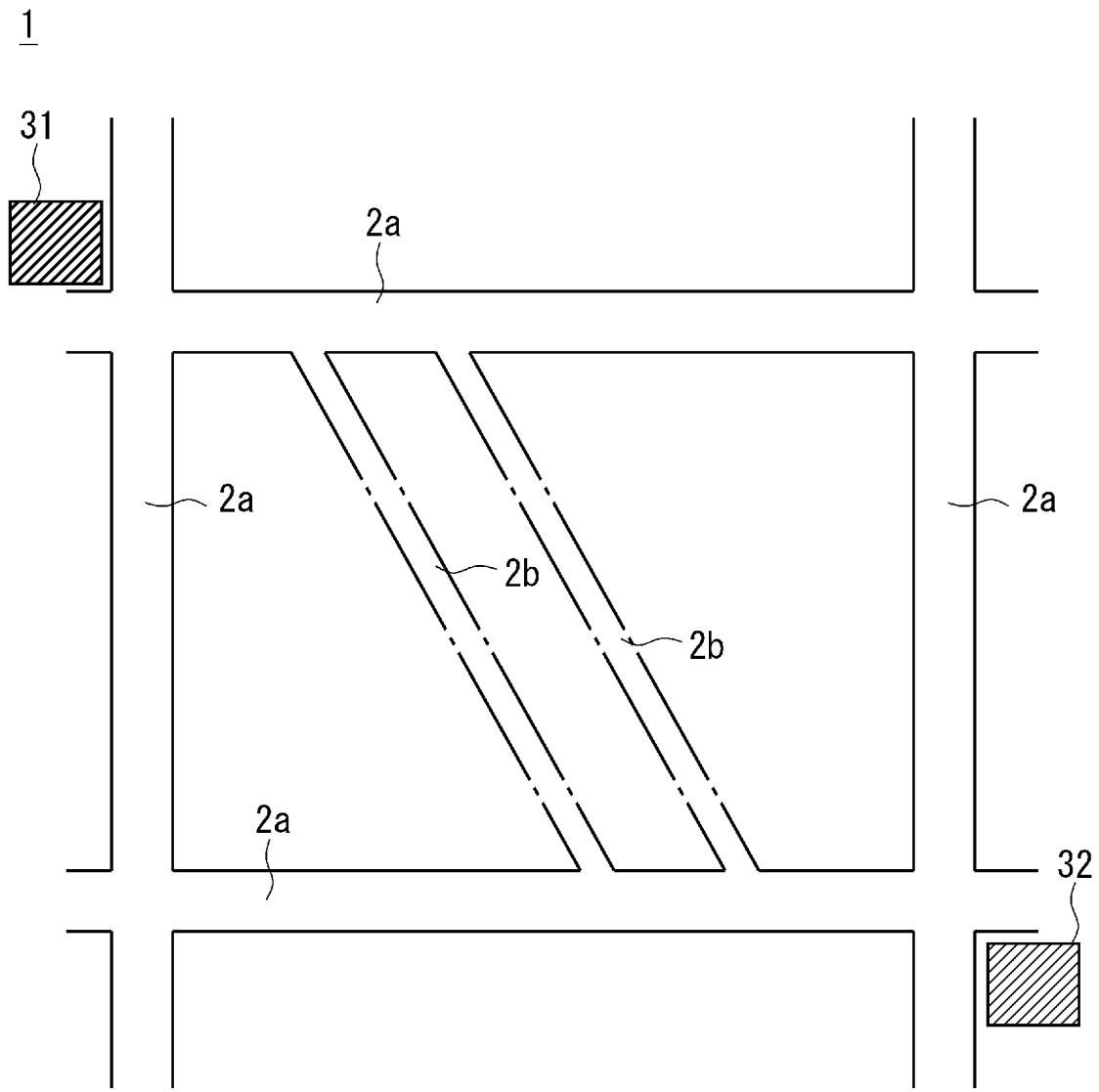
FIG. 4 is a schematic diagram showing an example of a traffic environment.

A specific example will be described with reference to FIGS. 4 and 5. FIG. 4 is a schematic diagram showing an example of the traffic environment 1. The transportation vehicle 300 transports a transported object from a starting place 31, which is a warehouse or the like, to a destination 32, which is a house or the like. The traffic environment 1 includes roads 2*a* which the transportation vehicle 300 travels through, and roads 2*b* which people pass through. The roads 2*b* are indicted by dashed lines. Note that the route may be one in which the roads 2*b* pass through (i.e., are extended across) an area such as a park or an open space. That is, the roads 2*b* may be passage areas that are used as an open square or a park under normal conditions, and parts of the passage areas may be defined (i.e., used) as roads. That is, the roads 2*b* do not necessarily have to be roads that actually exist.

Figure 5:
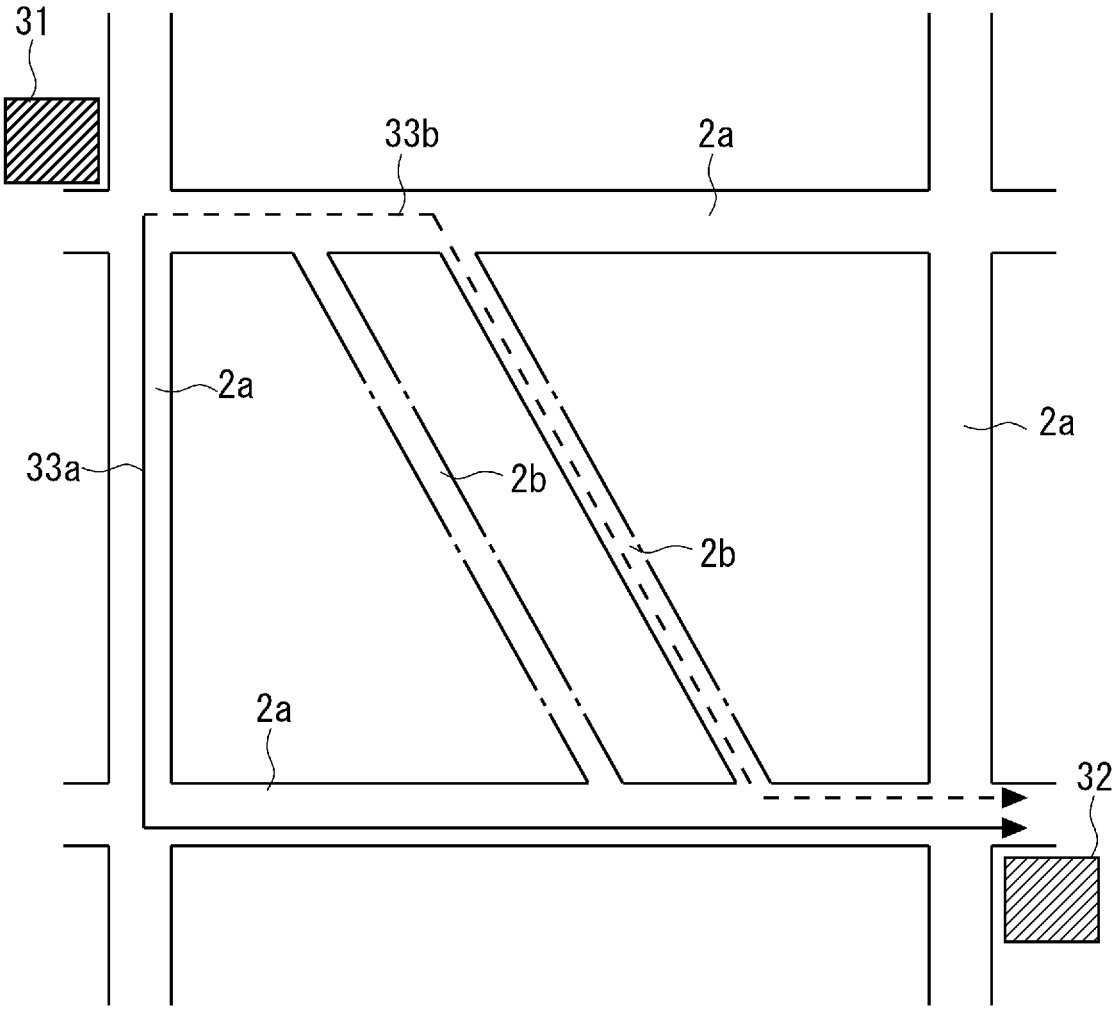
FIG. 5 is a schematic diagram showing a route in the case where regulation in regard to whether or not traveling is permitted is not changed, and a route in the case where the regulation is changed.

A route 33*a* shown in FIG. 5 is a traveling route for the transportation vehicle 300 in an ordinary case (in the case where the regulation in regard to the permission/prohibition of the traveling is not changed). On the other hand, a route 33*b* is an example of a traveling route in the case where the transportation vehicle 300 can travel through the roads 2*b*. Since the route 33*b* is shorter than the route 33*a*, the transportation time can be reduced. Further, when the number of transportation vehicles 300 is large, the transportation time can be reduced because the occurrence of a traffic jam can be prevented.

As described above, according to the first embodiment, it is possible to increase the number of roads which the transportation vehicle 300 can travel through, and thereby to reduce the transportation time of the transported object according to the demand information or the like. According to the first embodiment, for example, it is possible to prevent or reduce the increase in the transportation time in a time period (or in a season) in which the demand for transportation increases. Further, according to the first embodiment, for example, it is possible to prevent or reduce the increase in the transportation time when a traffic jam occurs.

Second Embodiment

Figure 6:
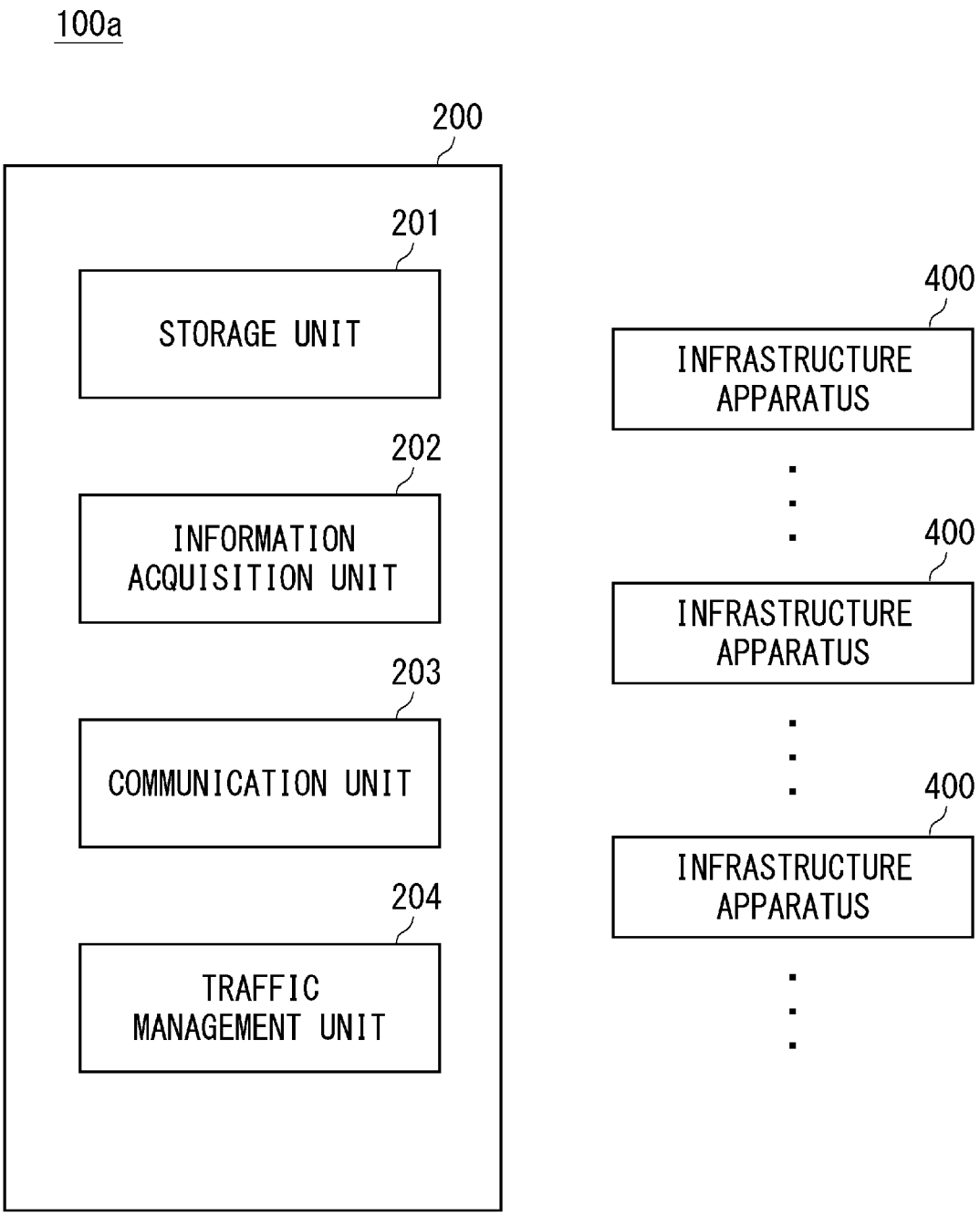
FIG. 6 is a block diagram showing a configuration of a traffic management system according to a second embodiment.

A traffic management system 100*a* according to a second embodiment relaxes the traveling condition for transportation vehicles by controlling, instead of the transportation vehicle 300, an infrastructure apparatus having a traffic guide function. The traffic management system 100*a* may change the regulation in regard to the permission/prohibition of the traveling through roads. FIG. 6 is a block diagram showing a configuration of the traffic management system 100*a* according to the second embodiment. In the following description, differences from the first embodiment will be mainly described. The transportation vehicle 300 may be a non-autonomously-driven vehicle driven by a human being.

The traffic management system 100*a* includes an infrastructure apparatus 400. The infrastructure apparatus 400 is a traffic infrastructure apparatus having a traffic guide function such as road tacks embedded in a road surface, a traffic signal, or LEDs (Light Emitting Diodes). The infrastructure apparatus 400 may be a digital signage capable of displaying text and the like. The infrastructure apparatus 400 is installed in the traffic environment. The transportation vehicle 300 (not shown) is equipped with a sensor such as a camera, and can recognize what is displayed in the infrastructure apparatus 400 by using the sensor. Further, when there is a human driver, the human driver can drive the transportation vehicle 300 while checking information displayed in the infrastructure apparatus.

The traffic management unit 204 controls the infrastructure apparatus 400 based on demand information, traffic-environment information, and the like acquired by the information acquisition unit 202. For example, a traffic signal or road tacks in the road for which the regulation has been changed may emit light in a predetermined pattern, or may emit light in a color different from a normal color. Alternatively, information indicating that the regulation has been changed may be displayed on a digital signage or the like. After changing the regulation, the traffic management unit 204 may output management information for permitting the transportation vehicle 300 to pass through the road or the like to the infrastructure apparatus 400.

Figure 7:
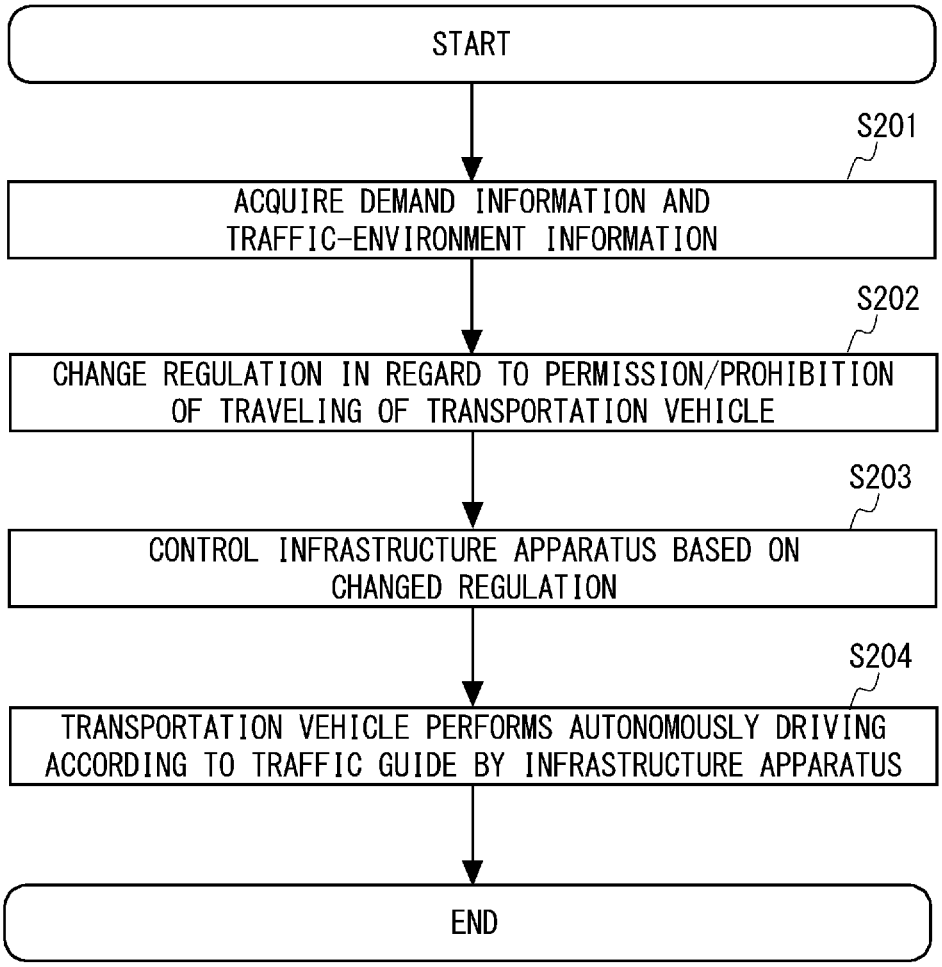
FIG. 7 is a flowchart showing operations performed by the traffic management system according to the second embodiment.

FIG. 7 is a flowchart showing an example of operations performed by the traffic management system 100*a*. The information acquisition unit 202 of the traffic management system 100*a* acquires demand information, traffic-environment information, and the like (Step S201). Next, the traffic management unit 204 of the traffic management system 100*a* changes the regulation in regard to the permission/prohibition of the traveling of the transportation vehicle in at least a part of the second road based on the information acquired in the step S201 (Step S202). Note that the traffic management unit 204 may relax only the traveling condition for the second road or the like, and does not necessarily have to change the regulation in regard to the permission/prohibition of the traveling. Next, the traffic management unit 204 of the traffic management system 100*a* transmits management information to the infrastructure apparatus 400 based on the regulation changed in the step S202, and thereby controls the infrastructure apparatus 400 (Step S203). The traffic management system 100*a* may, for example, change the color of a traffic signal installed in an intersection or the like connected to the second road, or may display information indicating that the transportation vehicle 300 can travel through the second road on the digital signage. Further, the traffic management unit 204 may also display information indicating that the traveling condition has been relaxed on the digital signage. Lastly, the transportation vehicle 300 is autonomously driven according to the traffic guide by the infrastructure apparatus 400 (Step S204). Note that a human driver may drive the transportation vehicle 300 according to the information displayed in the infrastructure apparatus 400.

As described above, even in the case where the infrastructure apparatus having the traffic guide function is used, it is also possible to relax the traveling condition for transportation vehicles according to the demand information and the like and thereby control the transportation time as appropriate as in the case of the first embodiment.

Third Embodiment

Figure 8:
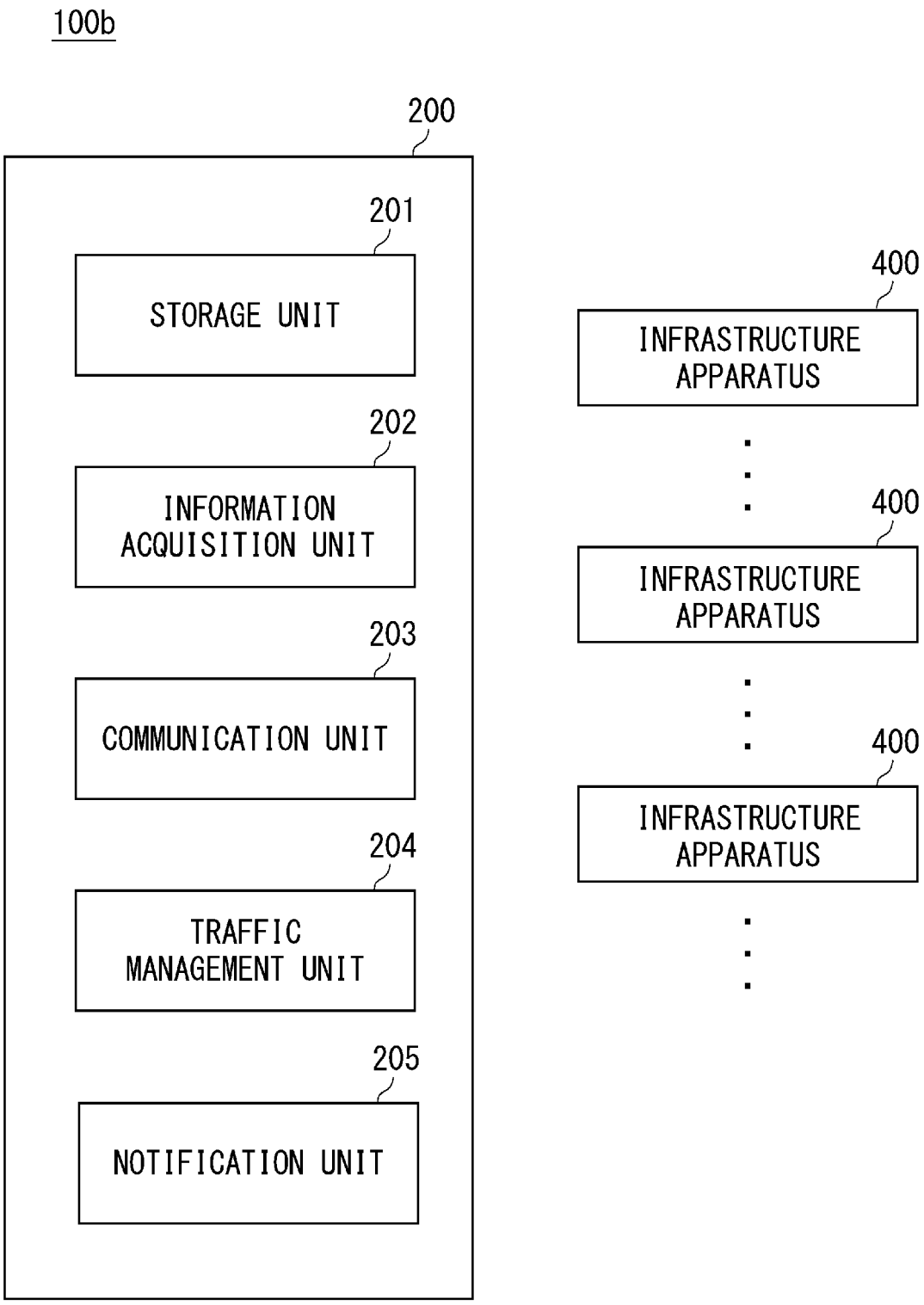
FIG. 8 is a block diagram showing a configuration of a traffic management system according to a third embodiment.

A traffic management system 100*b* according to a third embodiment simulates a transportation time based on demand information, traffic-environment information, and the like, and relaxes the traveling condition according to the result of the simulation. FIG. 8 is a block diagram showing a functional configuration of the traffic management system 100*b*. Note that the traffic management system 100*b* may control, instead of the infrastructure apparatus 400, the autonomous driving performed by the transportation vehicle 300. In the following description, differences from the first and second embodiments will be mainly described.

The information acquisition unit 202 acquires information necessary for the simulation of the transportation performed by the traffic management unit 204. The information necessary for the simulation is demand information and traffic-environment information. Further, the information acquisition unit 202 acquires setting conditions such as the number of vehicles and the day of the week. The setting conditions may be input from an input unit (not shown).

The traffic management unit 204 simulates a transportation time based on the information acquired by the information acquisition unit 202, and relaxes the traveling condition for the transportation vehicle 300 according to the result of the simulation.

Note that the traffic management unit 204 may perform a simulation for determining how much the regulation in regard to the permission/prohibition of the traveling should be changed. For example, assume that: the roads 2*a* are roads dedicated for electric vehicles (vehicles other than the transportation vehicles 300); the roads 2*b* are roads dedicated for the transportation vehicles 300 (conveyance robots and the like); and the roads 2*c* are roads dedicated for people. Under such an assumption, the traffic management unit 204 may perform a simulation of transportation in the case where the regulation in regard to the permission/prohibition of the traveling through the road 2*a* is changed, and perform a simulation of transportation in the case where the regulation in regard to the permission/prohibition of the traveling through the road 2*c* is changed. Further, the traffic management unit 204 may perform a simulation of transportation in the case where the regulation in regard to the permission/prohibition of the traveling through both the roads 2*a* and 2*c* is changed.

Figure 9:
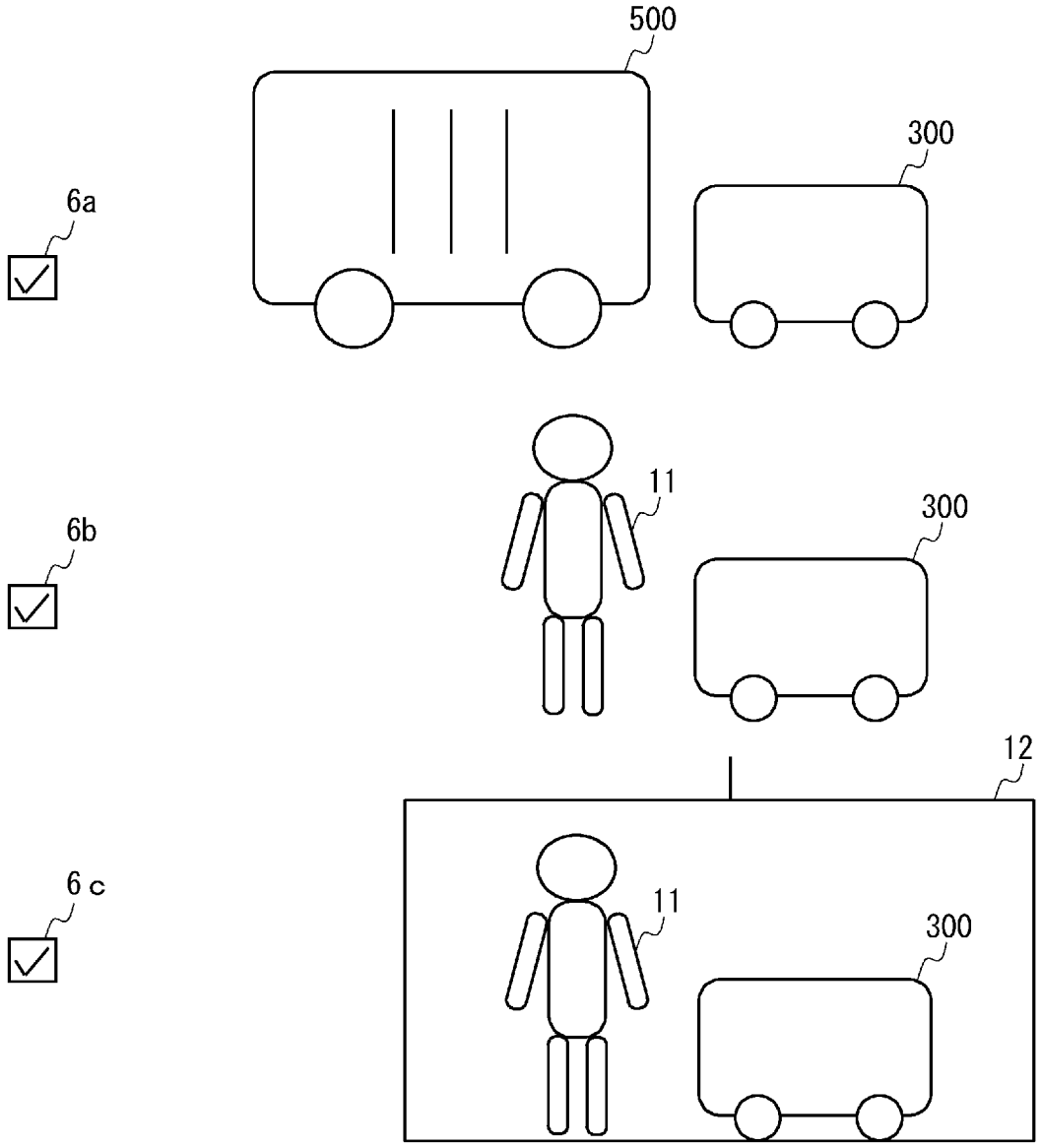
FIG. 9 is a schematic diagram showing an example of a display window for making a setting for roads to be used.

FIG. 9 is a schematic diagram showing an example of a display window for setting simulation conditions. The simulation conditions can be set by using check boxes 6*a* to 6*c*. The check box 6*a* is a check box for setting whether or not to change the regulation for the roads which other vehicles 500 such as electric vehicles and the like travel through. The check box 6*b* is a check box for setting whether or not to change the regulation for the roads which people 11 pass through. Further, the check box 6*c* is a check box for setting whether or not the transportation vehicle 300 uses an elevator dedicated for people. As described above, conditions other than those for setting roads can be set.

Figure 10:
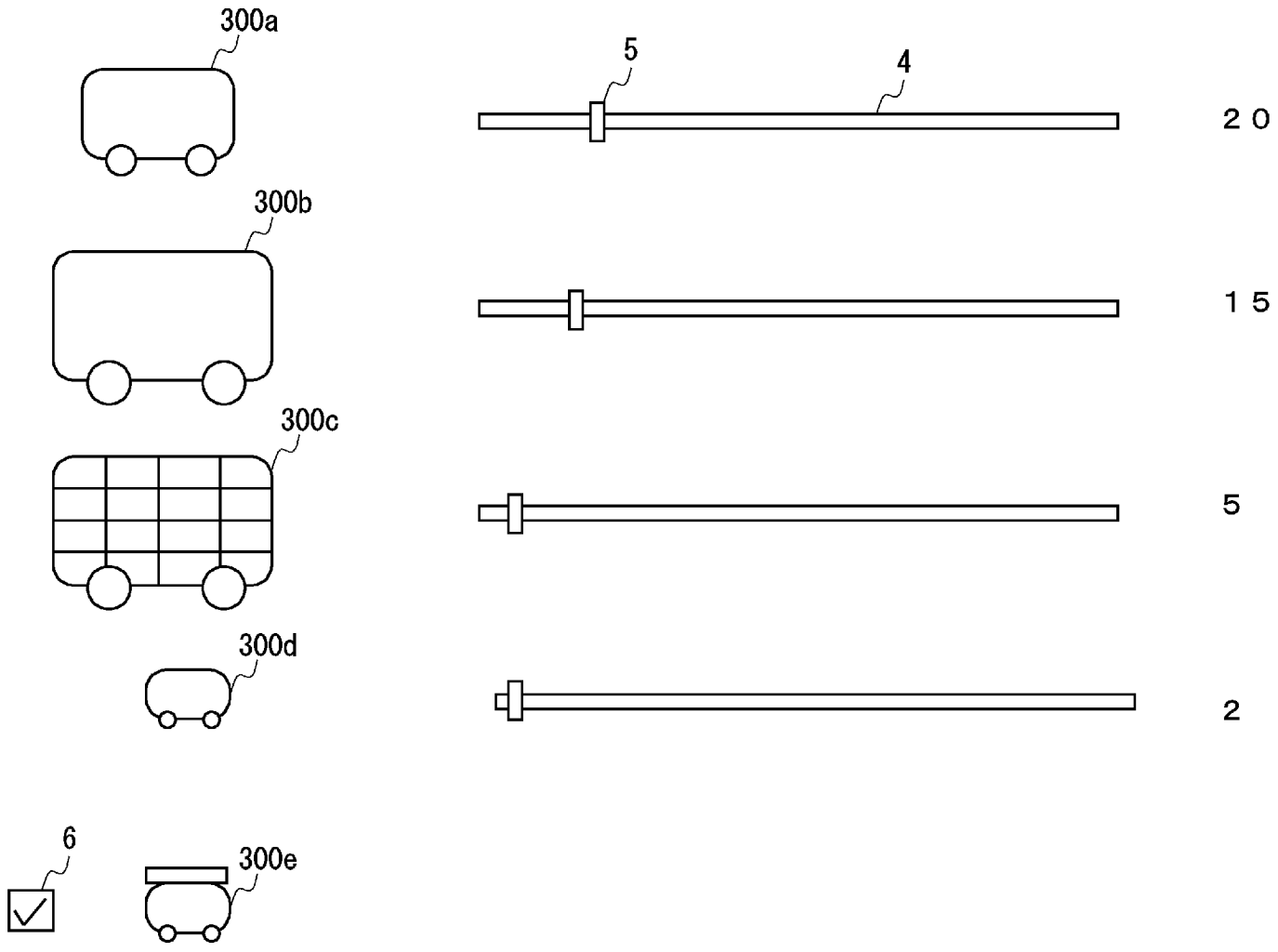
FIG. 10 is a schematic diagram showing an example of a display window for setting types of moving objects.

Further, when there are a plurality of types of vehicles that can be used as the transportation vehicle 300, the display window may be configured so that a user can select which types of vehicles should be used as the transportation vehicle 300 and, for each of the selected type, how much vehicles of that type should be used. FIG. 10 is a schematic diagram showing an example of a display window for setting conditions for a simulation. Transportation vehicles 300*a* to 300*d* are vehicles that can be used as the transportation vehicle 300. The types and the sizes of the transportation vehicles 300*a* to 300*d* differ from one vehicle to another. It is possible to determine, for each type of vehicles, the number of vehicles of that type by moving a slider 5 on a slider bar 4 in the left/right direction. A number such as a number "20" shown on the right side of the slider bar 4 indicates a number determined by the slider 5. Further, a check box 6 for determining whether or not to use a specific transportation vehicle 300*e* may be provided. Note that the number of transportation vehicles 300 may be the number of vehicles that can be used for transportation work, such as vehicles that are not in the charging process or the like.

Note that the management apparatus 200 may have a function of displaying, in a display apparatus, information indicating, for each transportation vehicle, where that transportation vehicle is located in order to set simulation conditions for the transportation vehicle 300. The display window may include a map of the traffic environment, and the locations of transportation vehicles may be indicated in the form of symbols on the map. The display window may be configured so that it is switched according to the type of the transportation vehicle 300. Further, the display window may be configured so that when a symbol is selected on the display window, the state of the corresponding transportation vehicle (such as its charging state, whether it is normally operating, or the type and the quantity of the load carried therein) may be further displayed. Note that the positions of persons may be indicated in the form of symbols on the map.

Note that, in the simulation, the speed and the like of the transportation vehicle 300 may be set. Further, in the case where the transportation vehicle 300 is a robot-type vehicle and has a function of, for example, guiding a person, whether or not this function should be restricted can be selected. By restricting such a function, the transportation vehicle 300 can transport a transported object to its destination more quickly.

Figure 11:
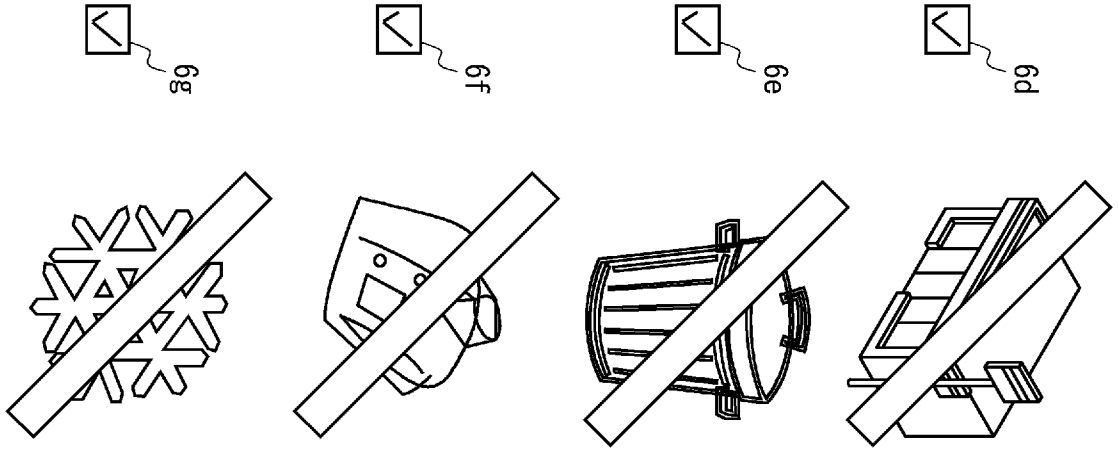
FIG. 11 is a schematic diagram showing an example of a display window for making a setting for services to be stopped.

Further, in the case where the transportation vehicle 300 can deliver a plurality of types of transported objects, the traffic management unit 204 may perform a simulation in the case where the transportation of at least one type of transported objects is suspended. The plurality of types of transported objects are, for example, objects delivered by a convenience store, garbage, laundry, frozen articles, and the like. FIG. 11 is a schematic diagram showing an example of a display window for making settings for a simulation. Check boxes 6*d* to 6*g* are check boxes for making settings for suspending a delivery service by a convenience store, garbage collection, a delivery of laundry, and a delivery service for a frozen article, respectively.

Figure 12:
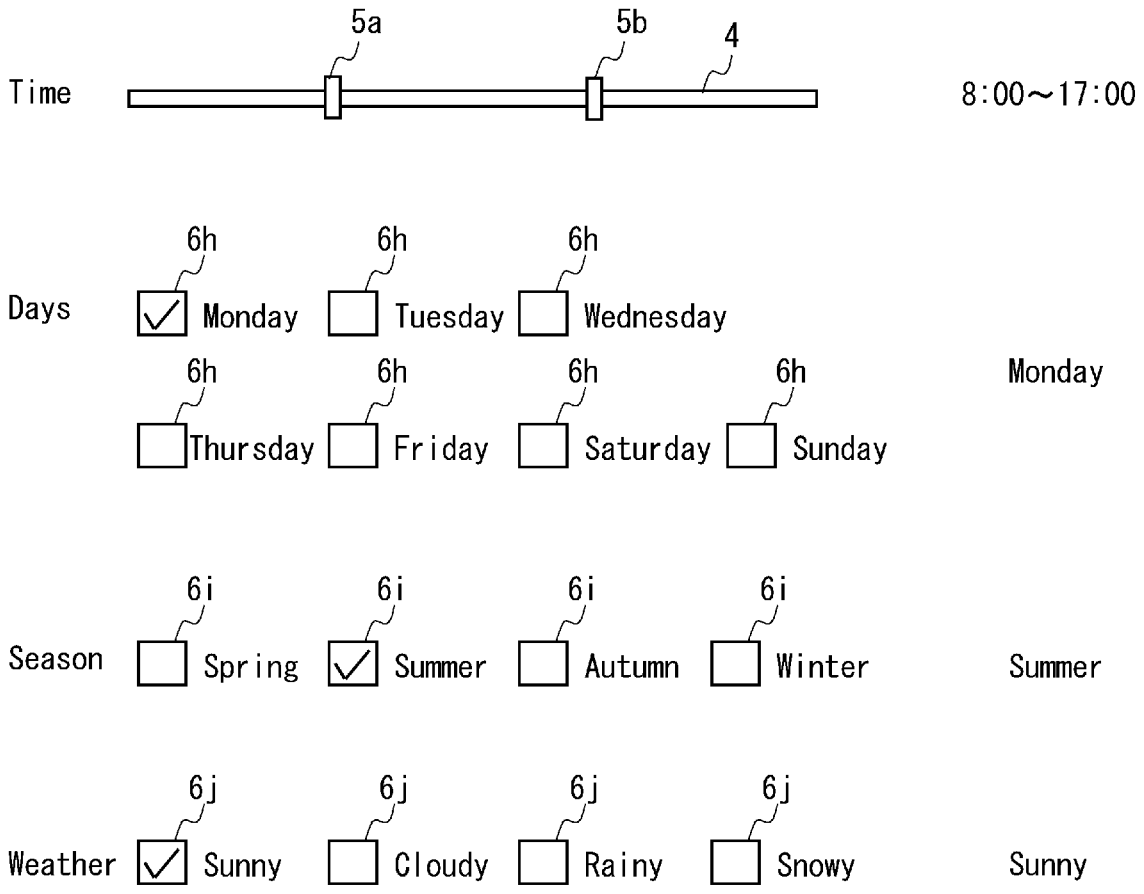
FIG. 12 is a schematic diagram showing an example of a display window for setting conditions for a simulation.

The simulation is performed by (i.e., after) setting conditions such as the day of the week and the time in the day. FIG. 12 is a schematic diagram showing an example of a display window for setting conditions for a simulation. The delivery time is set to a period from 8:00 to 17:00 by the sliders 5*a* and 5*b*. Further, the day of the week is set to Monday by the check box 6*h*. The season is set to summer by the check box 6*i*. Further, the weather is set to fine weather by the check box 6*j*.

Further, the simulation may be performed while taking pedestrians and the like into consideration. For example, the simulation may be performed by using the number of pedestrians, the density thereof, the speed thereof, and the like as conditions therefor. In the case where the transportation vehicle 300 can travel on the sidewalk or the like, the speed of pedestrians affects the transportation time. Further, the simulation may be performed while taking into account whether or not pedestrians are adults or children, and/or whether or not they are walking for some purposes.

Figure 13:
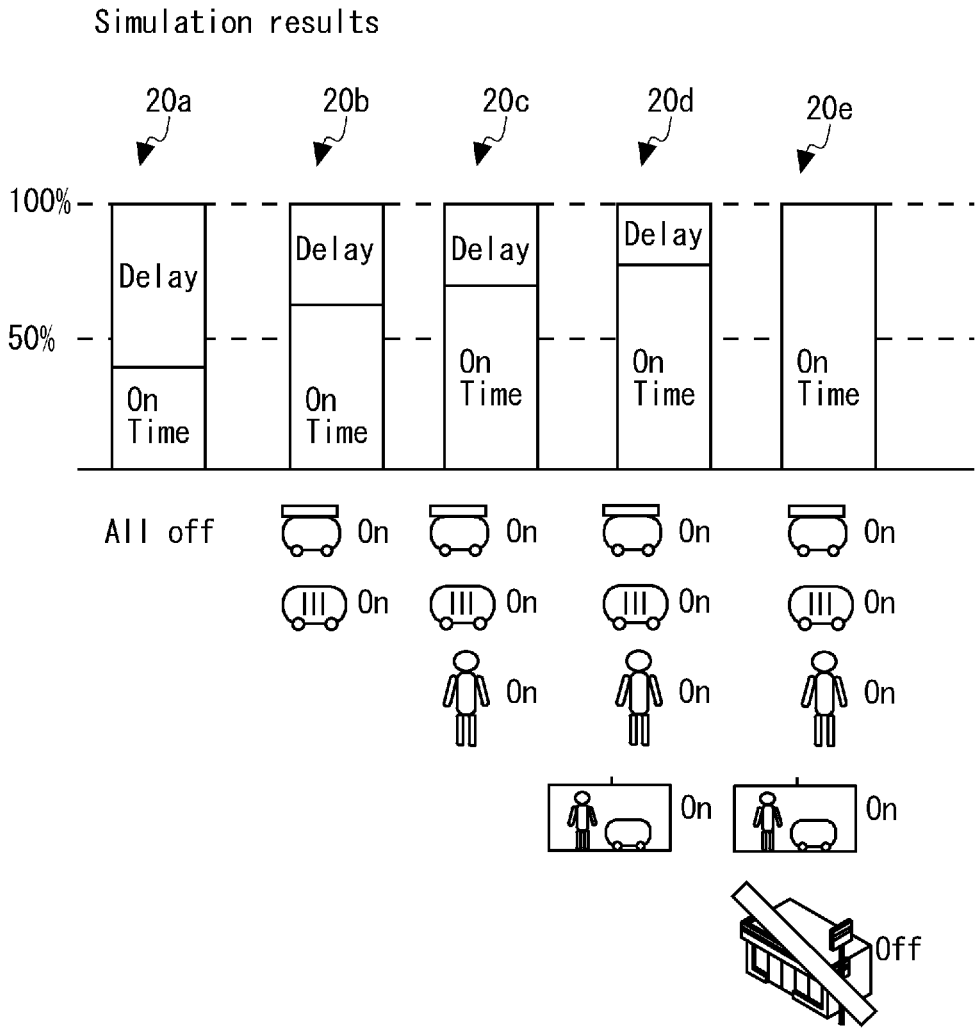
FIG. 13 is a schematic diagram showing an example of a display window for showing a simulation result.

FIG. 13 is an example of a display window showing a result of a simulation. In the drawing, "Delay" represents the ratio of transported objects for which delays have occurred during the deliveries, and "On time" represents the ratio of transported objects that can be delivered at or before the specified delivery times. Whether or not a delay has occurred in the delivery may be determined based on whether or not the transported object has been delivered within a predetermined delivery time.

The lower part in FIG. 13 shows conditions for the simulation. A simulation result 20*a* is a result of a simulation in the case where the roads which the transportation vehicle 300 can travel through are not changed. A simulation result 20*b* is a result of a simulation in the case where the transportation vehicle 300 is permitted to travel through roads for the other vehicles 500 shown in FIG. 9. A simulation result 20*c* is a result of a simulation in the case where the transportation vehicle 300 is also permitted to travel through roads through which people 11 walk. A simulation result 20*d* is a result of a simulation in the case where the transportation vehicle 300 is also permitted to get on an elevator 12 for people. A simulation result 20*e* is a result of a simulation in the case where the delivery service of a convenience store is also suspended.

Regarding the simulation, a simulation in the case where transportation is performed in such a manner that the power consumption is reduced, and a simulation in the case where transportation is performed without taking the power consumption into consideration may both be performed.

The traffic management unit 204 determines, for example, which roads the vehicle is permitted to travel therethrough according to the result of such a simulation. Further, the traffic management unit 204 may have a function of increasing the types of transportation vehicles and/or the number thereof according to the result of the simulation, and/or a function of restricting a transportation service according to the result of the simulation.

Returning to FIG. 8 again, a notification unit 205 of the management apparatus 200 gives a notification that the traveling condition for the transportation vehicle 300 has been relaxed in the second passage area which people pass through. When the regulation in regard to the permission/prohibition of the traveling is changed, the notification unit 205 may notify terminals possessed by pedestrians and/or the infrastructure apparatus 400 of information about the increase in the number of transportation vehicles 300. For example, when the regulation for roads which people can pass through is changed, the notification unit 205 notifies pedestrians present near the roads that the regulation has been changed. The content of the notification is, for example, "A transportation robot may travel through the sidewalk in a period from a time xx to a time yy. Please be careful about the robot." The notification may be made by sound or voice. Note that the notification unit 205 may notify pedestrians again when the regulation in regard to the permission/prohibition of the traveling is restored (i.e., changed to the original one).

Figure 14:
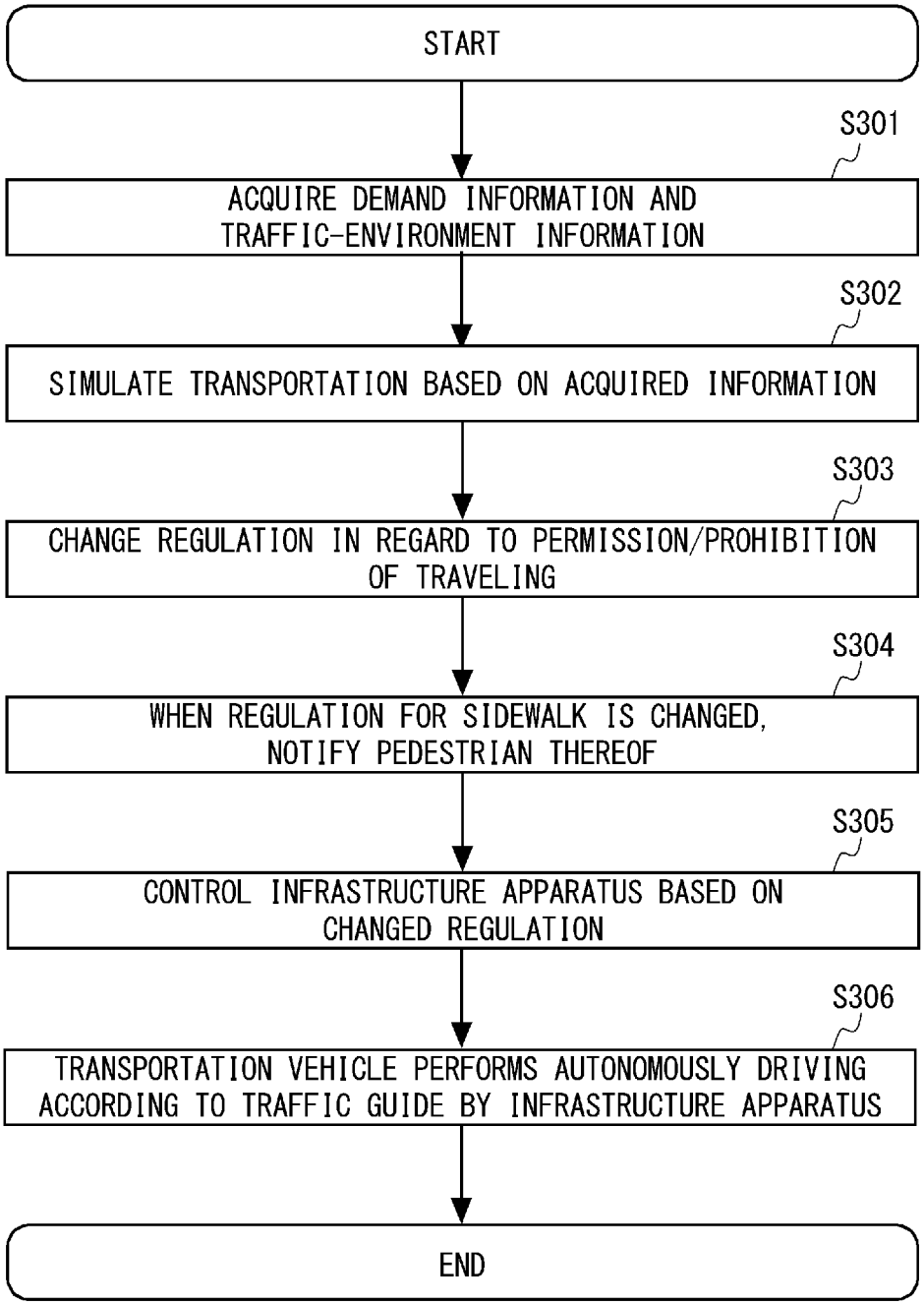
FIG. 14 is a flowchart showing operations performed by a traffic management system according to the third embodiment.

FIG. 14 is a flowchart showing operations performed by the traffic management system 100*b*. The information acquisition unit 202 of the traffic management system 100*b* acquires demand information and traffic-environment information (Step S301). Further, the information acquisition unit 202 acquires setting conditions necessary for a simulation. Next, the traffic management unit 204 simulates transportation performed by the transportation vehicle 300 based on the information acquired in the step S301 (Step S302). The traffic management unit 204 changes the regulation in regard to the permission/prohibition of the traveling according to the result of the simulation in the step S302 (Step S303). Note that, as described above, the traffic management unit 204 may relax the traveling condition, and does not necessarily have to change the regulation in regard to the permission/prohibition of the traveling. Note that when the traveling condition for the sidewalk is relaxed (e.g., when the vehicle is permitted to travel on the sidewalk), pedestrians are notified thereabout (Step S304). The notification may be sent to communication terminals possessed by pedestrians, or may be sent to a digital signage installed in the sidewalk. Lastly, the traffic management unit 204 controls the infrastructure apparatus 400 and the like based on the regulation changed in the step S303 (Step S305), and the transportation vehicle 300 is autonomously driven according to the traffic guide by the infrastructure apparatus 400 (Step S306). Note that a human driver may drive the transportation vehicle 300 according to the instructions from the infrastructure apparatus 400.

As described above, it is possible to appropriately select roads for which the regulation is changed by performing a simulation of transportation. Further, it is possible to make pedestrians recognize the change in the regulation in regard to the permission/prohibition of the traveling by notifying them thereof, and thereby to urge the pedestrians to pay attention thereto.

The program executed by the management apparatus 200 includes instructions (or software codes) that, when loaded into a computer, cause the computer to perform one or more of the functions described in the embodiments. The program may be stored in a non-transitory computer readable medium or a tangible storage medium. By way of example, and not a limitation, non-transitory computer readable media or tangible storage media can include a random-access memory (RAM), a read-only memory (ROM), a flash memory, a solid-state drive (SSD) or other types of memory technologies, a CD-ROM, a digital versatile disc (DVD), a Blu-ray disc or other types of optical disc storage, and magnetic cassettes, magnetic tape, magnetic disk storage or other types of magnetic storage devices. The program may be transmitted on a transitory computer readable medium or a communication medium. By way of example, and not a limitation, transitory computer readable media or communication media can include electrical, optical, acoustical, or other forms of propagated signals.

Note that the present disclosure is not to be limited to the above-described embodiments and they can be modified as appropriate without departing from the scope and spirit of the present disclosure.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A traffic management system in a traffic environment including a plurality of types of passage areas, the plurality of types of passage areas being regulated so that types of moving objects permitted to pass therethrough differ from one passage area to another, wherein the plurality of passage areas include a first passage area and a second passage area, the first passage area being a passage area for which a traveling condition for a transportation vehicle carrying an object to be transported is specified, and being a road, and a second passage area being a passage area for which a traveling condition for restricting traveling of the transportation vehicle more strictly than in the first passage area is specified, the traffic management system comprises a traffic management unit configured to relax a traveling regulation for the transportation vehicle in at least a part of the second passage area based on at least one of information about a demand for the object to be transported and information about a traffic environment, the traffic management unit simulates a transportation time of the transportation vehicle based on at least one of the information about the demand for the object to be transported and the information about the traffic environment, and relaxes the traveling condition according to a result of the simulation, and the traffic management unit controls an infrastructure apparatus based on the demand information and the traffic-environment information by causing the infrastructure apparatus to emit light in a predetermined pattern or in a different color from a normal color.

2. The traffic management system according to claim 1, wherein the first passage area is a first road for which it is specified that the transportation vehicle can travel therethrough, the second passage area is a second road for which it is specified that the transportation vehicle cannot travel therethrough, and the traffic management unit changes the regulation in regard to permission/prohibition of the traveling of the transportation vehicle in at least a part of the second passage area based on at least one of the information about the demand for the object to be transported and the information about the traffic environment.

3. The traffic management system according to claim 1, wherein the traffic management unit outputs management information for relaxing the traveling condition of the transportation vehicle to at least one of an infrastructure apparatus having a traffic guide function in the traffic environment and the transportation vehicle, and thereby relaxes the traveling condition.

4. The traffic management system according to claim 1, wherein a second traffic area is a traffic area through which people pass, and the traffic management system further comprises a notification unit configured to give a notification that the traveling condition is relaxed when the traveling condition is relaxed in the second passage area through which people pass.

5. A method for managing traffic in a traffic environment including a plurality of types of passage areas, the plurality of types of passage areas being regulated so that types of moving objects permitted to pass therethrough differ from one passage area to another, wherein the plurality of passage areas include a first passage area and a second passage area, the first passage area being a passage area for which a traveling condition for a transportation vehicle carrying an object to be transported is specified, and being a road, and a second passage area being a passage area for which a traveling condition for restricting traveling of the transportation vehicle more strictly than in the first passage area is specified, the method comprises relaxing the traveling condition for the transportation vehicle in at least a part of the second passage area based on at least one of information about a demand for the object to be transported and information about a traffic environment, simulating a transportation time of the transportation vehicle based on at least one of the information about the demand for the object to be transported and the information about the traffic environment, and relaxing the travel condition according to a result of the simulation and, controlling an infrastructure apparatus based on the demand information and the traffic-environment information by causing the infrastructure apparatus to emit light in a predetermined pattern or in a different color from a normal color.

6. A non-transitory computer readable medium storing a traffic management program in a traffic environment including a plurality of types of passage areas, the plurality of types of passage areas being regulated so that types of moving objects permitted to pass therethrough differ from one passage area to another, wherein the plurality of passage areas include a first passage area and a second passage area, the first passage area being a passage area for which a traveling condition for a transportation vehicle carrying an object to be transported is specified, and being a road, and a second passage area being a passage area for which a traveling condition for restricting traveling of the transportation vehicle more strictly than in the first passage area is specified, the traffic management program causes a computer to perform relaxing the traveling condition for the transportation vehicle in at least a part of the second passage area based on at least one of information about a demand for the object to be transported and information about a traffic environment, the traffic management program simulates a transportation time of the transportation vehicle based on at least one of the information about the demand for the object to be transported and the information about the traffic environment, and relaxes the traveling condition according to a result of the simulation, and the traffic management program controls an infrastructure apparatus based on the demand information and the traffic-environment information by causing the infrastructure apparatus to emit light in a predetermined pattern or in a different color from a normal color.

* * * * *